US008091522B2

(12) United States Patent
Minato et al.

(10) Patent No.: US 8,091,522 B2
(45) Date of Patent: Jan. 10, 2012

(54) VARIABLE VALVE DRIVING DEVICE

(75) Inventors: Akihiko Minato, Kanagawa (JP); Terukazu Nishimura, Kanagawa (JP); Takeshi Tokumaru, Kanagawa (JP); Tsuneo Tanaka, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 531 days.

(21) Appl. No.: 12/300,467

(22) PCT Filed: Apr. 26, 2007

(86) PCT No.: PCT/JP2007/059043

§ 371 (c)(1),
(2), (4) Date: Nov. 12, 2008

(87) PCT Pub. No.: WO2007/132662

PCT Pub. Date: Nov. 22, 2007

(65) Prior Publication Data

US 2009/0250023 A1 Oct. 8, 2009

(30) Foreign Application Priority Data

May 15, 2006 (JP) ..... 2006-135002

(51) Int. Cl.
*F01L 9/02* (2006.01)

(52) U.S. Cl. ..... 123/90.12; 123/90.13; 123/90.39; 123/90.44

(58) Field of Classification Search ..... 123/90.12, 123/90.13, 90.39, 90.44
See application file for complete search history.

(56) References Cited

U.S. PATENT DOCUMENTS 6,732,685 B2 * 5/2004 Leman ..... 123/90.12
2003/0145812 A1 8/2003 Leman

FOREIGN PATENT DOCUMENTS

JP 7259518 A 10/1995
JP 2970388 B2 11/1999
JP 2006-97534 A 4/2006
WO 03067036 A1 8/2003

OTHER PUBLICATIONS

International Search Report for PCT/JP2007/059043 dated Aug. 14, 2007.

* cited by examiner

*Primary Examiner* — Ching Chang
(74) *Attorney, Agent, or Firm* — McCormick, Paulding & Huber LLP

(57) ABSTRACT

To provide a variable valve driving device which can accurately control the lift amount of valves and can be manufactured at a low cost. The device has: valves (10) serving as intake valves or exhaust valves of an engine; springs (11) for biasing the valves (10) in the valve closing direction; a cam (12) for pressing the valves (10) in the valve opening direction against a biasing force of the springs; a piston (19) joined to the valves (10); a control chamber (21) configured by a piston insertion hole (20) into which the piston (19) is inserted; and a control mechanism (24) for changing the valve closing timing of the valves (10) by controlling the introduction and discharge of a working fluid into and from the control chamber (21).

6 Claims, 4 Drawing Sheets

VARIABLE VALVE DRIVING DEVICE

CROSS REFERENCE TO RELATED APPLICATIONS

This application is entitled to the benefit of and incorporates by reference essential subject matter disclosed in International Patent Application No. PCT/JP2007/059043 filed on Apr. 26, 2007 and Japanese Patent Application No. 2006-135002 filed May 15, 2006.

TECHNICAL FIELD

The present invention relates to a valve driving device of an engine, and more particularly to a valve driving device which can change the closing timing of valves.

BACKGROUND

Delaying the closing of an intake valve when an engine piston compression rises from a bottom dead center is known to be effective for controlling the ignition timing of fuel in a Miller cycle or premixed combustion (PCI combustion).

For example, a variable valve driving device disclosed in Japanese Patent No. 2970388 has been suggested as a device capable of changing the closing timing of intake valves.

Japanese Patent No. 2970388 discloses a variable valve driving device including a plunger that is driven by a cam in a cylinder head of an engine, an actuator for pressing an intake valve communicating with a plunger chamber pressurized by the plunger in the valve opening direction, a hydraulic pump for supplying hydraulic pressure into the plunger chamber, a hydraulic chamber provided between a retainer of the intake valve and the cylinder head that presses the intake valve in the valve closing direction, switching means inserted into a channel which links the plunger chamber to the hydraulic chamber, and an accumulator connected between the hydraulic chamber of the channel and the switching means.

In such variable valve driving device, when the intake valve is lifted, the plunger chamber and hydraulic chamber are disconnected by the switching means, the actuator is driven by a hydraulic pressure of the plunger chamber which is pressurized by the plunger driven by the cam, and the intake valve is opened. The hydraulic pressure of the hydraulic chamber, which is pressurized as the intake valve is opened, is accumulated in the accumulator. Where the plunger chamber and hydraulic chamber are linked by the switching means in the lifting process of the intake valve, the hydraulic pressure created by the pressurization of the plunger chamber and the hydraulic pressure accumulated in the accumulator are supplied into the hydraulic chamber and the intake valve is closed.

DISCLOSURE OF THE INVENTION

However, in the above-described variable valve driving device, because the lift amount of the intake valve changes depending on the compressibility of the working oil in the plunger chamber and the like, the lift amount of the intake valve is difficult to control with good accuracy.

Further, in the above-described variable valve driving device, because the scope of changes introduced in the conventional valve driving device of a cam system is significant and the structure is complex, the production cost rises.

Accordingly, it is an object of the present invention to provide a variable valve driving device which can accurately control the lift amount of the valves and can be manufactured at a low cost.

In order to attain the above-described object, the invention set forth in claim 1 provides a variable valve driving device, comprising valves serving as intake valves or exhaust valves of an engine, springs for biasing the valves in the valve closing direction, a cam for pressing the valves in the valve opening direction against a biasing force of the springs, a piston joined to the valves, a control chamber configured by a piston insertion hole into which the piston is inserted, and a control mechanism for changing a valve closing timing of the valves by controlling the introduction and discharge of a working fluid into and from the control chamber.

The invention set forth in claim 2 provides the variable valve driving device according to claim 1, wherein when the valves are closed with a delay with respect to the valve closing timing corresponding to a cam profile of the cam, the control mechanism regulates the discharge of the working fluid introduced into the control chamber, whereby the working fluid is held in the control chamber.

The invention set forth in claim 3 provides the variable valve driving device according to claim 1 or 2, wherein the control mechanism has a working fluid tank connected to the control chamber, a first actuation valve for introducing the working fluid of the working fluid tank into the control chamber, and a second actuation valve for discharging the working fluid of the control chamber into the working fluid tank.

The invention set forth in claim 4 provides the variable valve driving device according to any of claims 1 to 3, wherein the valves are pressed by the cam directly or pressed by the cam via a rocker arm.

The invention set forth in claim 5 provides the variable valve driving device according to any of claims 1 to 4, wherein the control chamber is disposed on the side opposite the valves with respect to a pressure application point in which the cam or the rocker arm presses the valves.

The invention set forth in claim 6 provides the variable valve driving device according to any of claims 1 to 5, wherein the control chamber is disposed on an extension of an axial line of the valves.

The present invention demonstrates an excellent effect of being capable of providing a variable valve driving device which can accurately control the lift amount of the valve and can be manufactured at a low cost.

BEST MODE FOR CARRYING OUT THE INVENTION

The preferred embodiments of the present invention will be described below with reference to the appended drawings.

Figure 1:
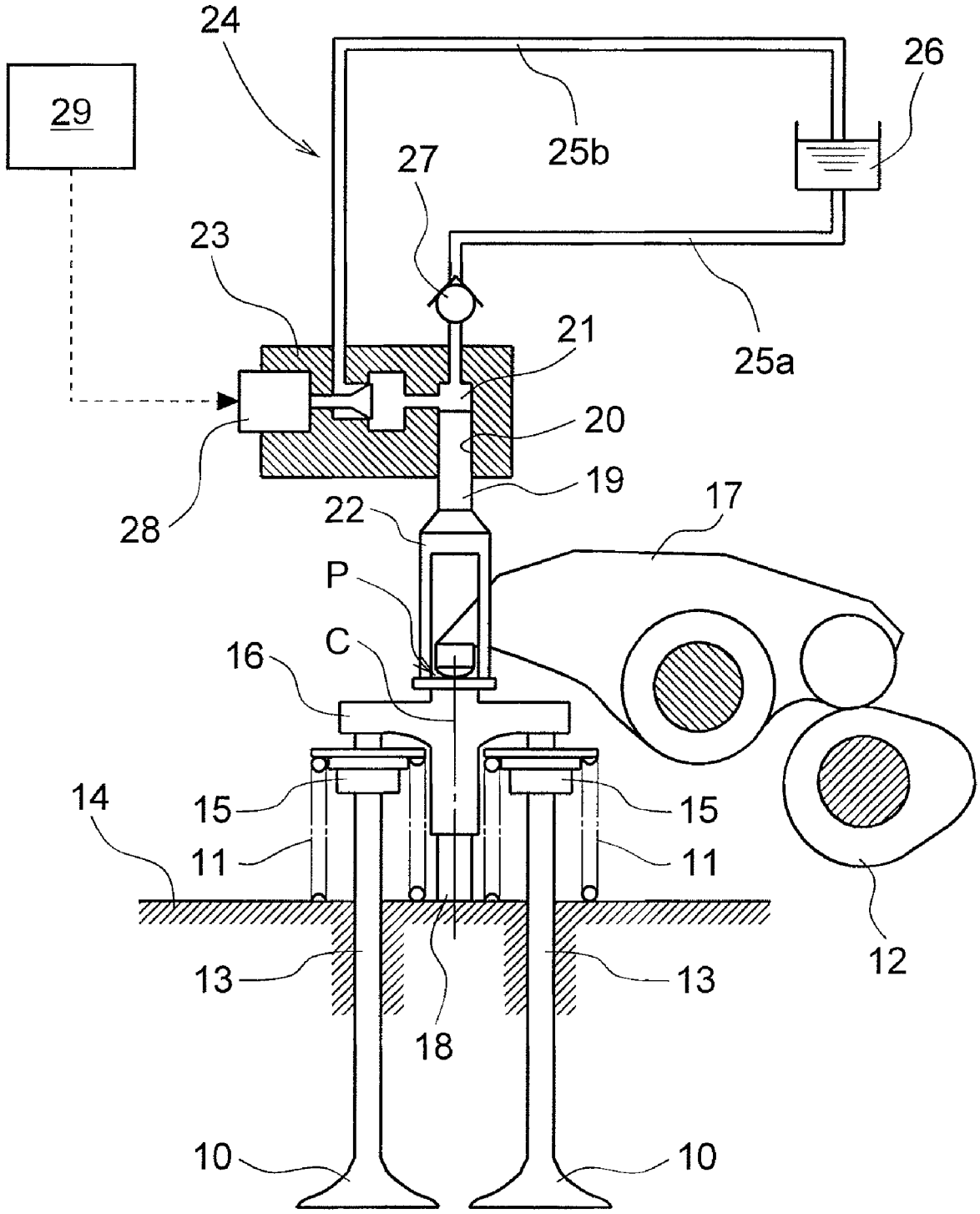
FIG. 1 is a schematic diagram of the variable valve driving device of an embodiment of the present invention, this diagram illustrating a state in which the valve is closed.

FIG. 1 is a schematic diagram of a variable valve driving device of one embodiment of the present invention.

The variable valve driving device of the present embodiment is applied to a four-valve engine.

The variable valve driving device of the present embodiment includes valves (engine valves) 10 serving as intake valves or exhaust valves of an engine, springs (valve springs) 11 for biasing the valves 10 in the valve closing direction (upward direction in FIG. 1), and a cam 12 for pressing the valves 10 in the valve opening direction (downward direction in FIG. 1) against a biasing force of the springs 11.

The valve 10 is supported by a cylinder head 14 at a valve stem 13 thereof so that the valve 10 can move up and down in the cylinder head 14.

A retainer (valve retainer) 15 is attached to the valve 10, and the spring 11 is installed in a compressed state between the retainer 15 and the cylinder head 14.

A bridge (valve bridge) 16 of an approximately T-like shape is attached to the valves 10, and a rocker arm 17 is engaged with the upper portion of the bridge 16. The bridge 16 is supported on a guide pin 18 which is fixedly attached to the cylinder head 14, so that the bridge 16 can move up and down.

The cam 12 is designed to press the valves 10 via the rocker arm 17. In other words, the valves 10 are pressed by the cam 12 via the rocker arm 17.

The variable valve driving device of the present embodiment includes a piston (plunger) 19 joined to the valves 10 and installed in a position in which it is not directly pressed by the cam 12, and a control chamber 21 configured by a piston insertion hole 20 into which the piston 19 can be inserted.

A bridge-like auxiliary member 22 having formed therein an opening for passing the rocker arm 17 therethrough is attached to the upper portion of the bridge 16, and the piston 19 is attached to the upper portion of the auxiliary member 22.

The control chamber 21 is bounded and formed by the piston insertion hole 20 formed in a housing 23 and the upper surface of the piston 19 inserted into the piston insertion hole 20. The housing 23 is fixedly attached to the cylinder head 14 (this is not shown in the figure).

The control chamber 21 is installed on the side opposite the valves 10 (upper side in FIG. 1) with respect to a pressure application point P at which the rocker arm 17 presses the valves 10 (bridge 16). Further, the control chamber 21 is disposed on an extension of an axial line C of the valves 10 (bridge 16).

The variable valve driving device of the present embodiment includes a control mechanism 24 for changing the valve closing timing of the valves 10 by controlling the introduction and discharge of a working fluid (working oil) into and from the control chamber 21.

The control mechanism 24 has a working fluid tank (working oil tank) 26 connected to the control chamber 21 via an introduction line 25*a* and a discharge line 25*b*, a first actuation valve 27 provided in the intermediate section of the introduction line 25*a* and serving to introduce the working oil of the working oil tank 26 into the control chamber 21, and a second actuation valve 28 provided in the intermediate section of the discharge line 25*b* and serving to discharge the working fluid of the control chamber 21 into the working oil tank 26.

The first actuation valve 27 is composed of a check valve (backflow preventing valve). In the check valve 27, the side of the working fluid tank 26 is an inlet side, and the side of the control chamber 21 is an outlet side. Once the pressure inside the control chamber 21 becomes negative, the check valve 27 is immediately opened, and when the check valve 27 is open, the working oil of the working oil tank 26 can be introduced into the control chamber 21.

The second actuation valve 28 is composed of a control valve (electromagnetic valve). The opening and closing of the control valve 28 is controlled by a controller 29, and when the control valve 28 is open, the working fluid of the control chamber 21 can be discharged into the working oil tank 26. The control valve 28 may be of an NO (normally open) type or an NC (normally closed) type.

The operation of the embodiment will be described below. In this case, the control valve 28 is of an NC type.

Figure 3:
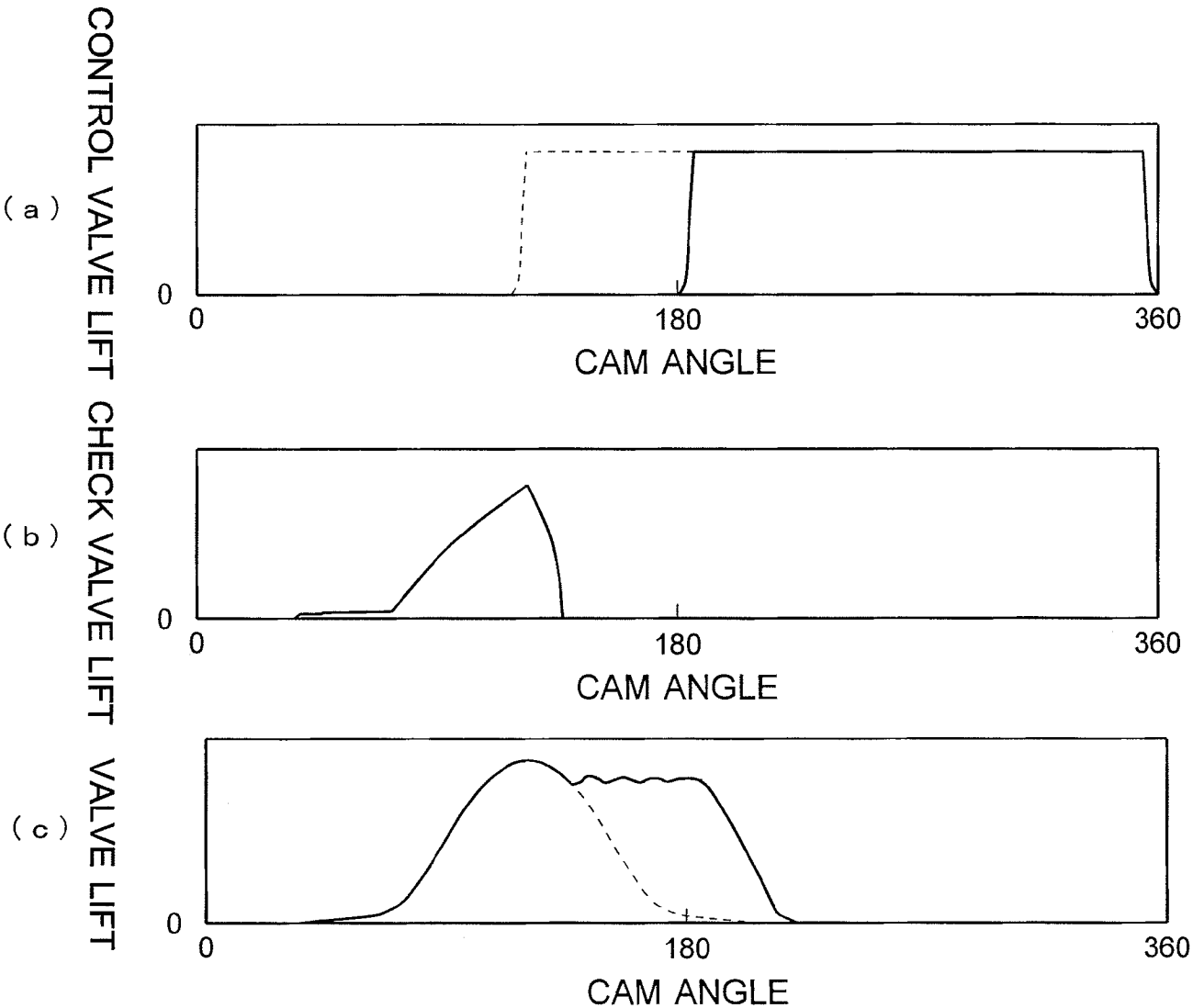
FIG. 3(*a*) to FIG. 3(*c*) show graphs illustrating the lift amount of the control valve, lift amount of the check valve, and lift amount of the valve.

When the valves 10 are open, the control valve 28 is closed (see FIG. 3(*a*)).

The valves 10 are pressed by the cam 12 in the valve opening direction against the biasing force of the springs 11, and the valves 10 are opened following the cam profile (shape of cam peak) of the cam 12 (see FIG. 3(*c*)). In this case, the piston 19 joined to the valves 10 (bridge 16) is also moved in the valve opening direction of the valves 10.

Because the control valve 28 is closed and the piston 19 is moved in the valve opening direction of the valves 10, the pressure in the control chamber 21 becomes a negative pressure and the check valve 27 is immediately opened (see FIG. 3(*b*)). As a result, the working oil of the working oil tank 26 is introduced (sucked) into the control chamber 21 via the introduction line 25*a*, following the movement of the piston 19.

When the valves 10 are closed with a delay with respect to the valve closing timing corresponding to the cam profile of the cam 12 (when a delayed closing operation is performed), the control valve 28 remains closed when the cam 12 moves to the valve closing side over the peak position.

Where the cam 12 moves over the peak position, the valves 10 are moved in the valve closing direction by the biasing force of the springs 11. In this case, the piston 19 is also moved in the valve closing direction of the valves 10.

Because the control valve 28 is closed and the piston 19 is moved in the valve closing direction of the valves 10, the working oil introduced into the control chamber 21 is compressed by the piston 19, the pressure in the control chamber 21 becomes positive, and the check valve 27 is immediately closed (see FIG. 3(*b*)). Because the control chamber 21 is tightly closed when the valves 10 are closed, the discharge of the working oil introduced into the control chamber 21 is controlled and the working oil is held in the control chamber 21.

Figure 2:
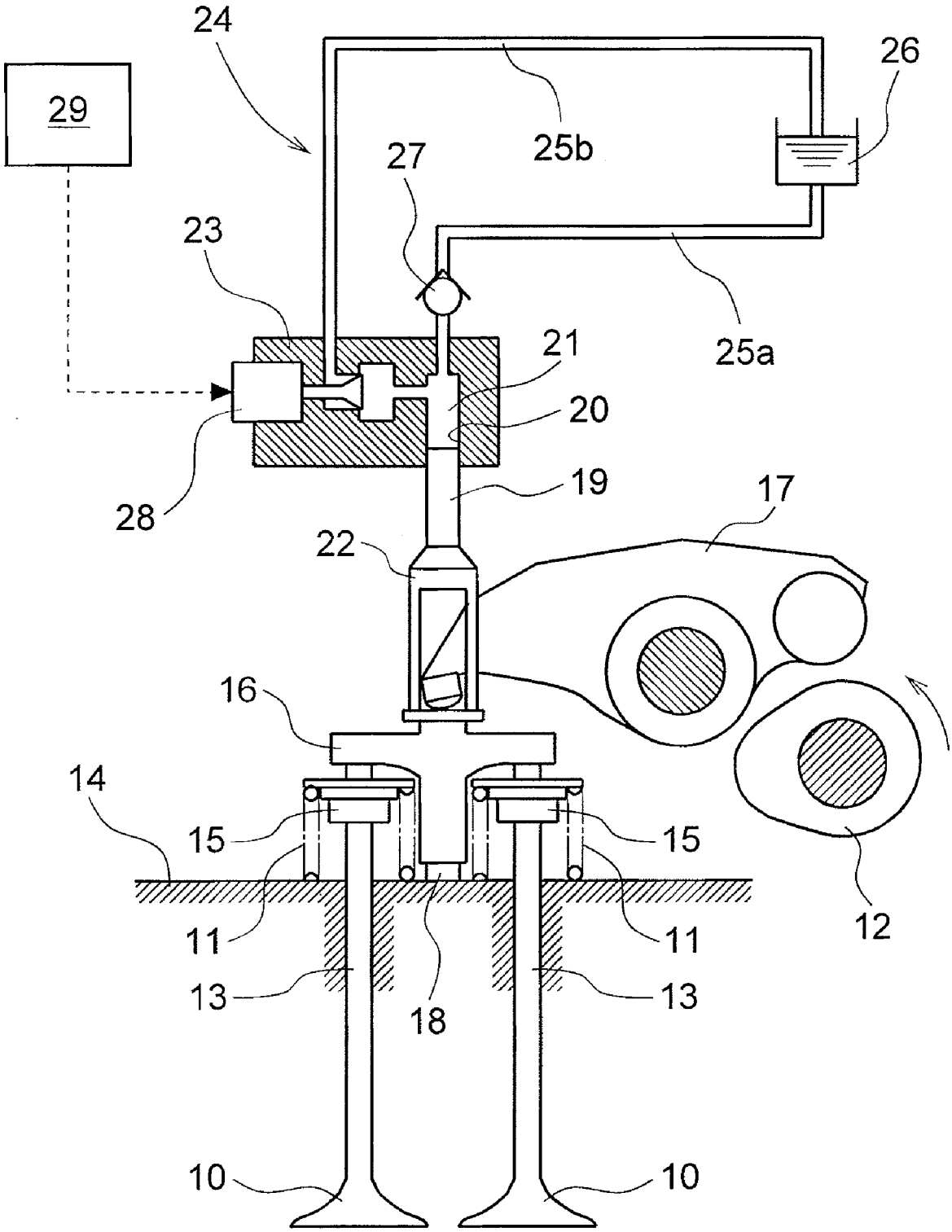
FIG. 2 is a schematic diagram of the variable valve driving device of the embodiment shown in FIG. 1, this diagram illustrating a state in which the valve is maintained in an open state.

The piston 19 is then further moved in the valve closing direction of the valves 10 and a state is assumed in which the biasing force of the springs 11 is balanced by the pressure in the control chamber 21. As a result, as shown in FIG. 2, the valves 10 can be held in an open state.

Where the control valve 28 is then opened at any timing, the valve 16 and piston 19 are moved in the valve closing direction by the biasing force of the springs 11. Therefore, the working oil of the control chamber 21 is discharged by the piston 19 into the working oil tank 26 via the discharge line 25*b*. The valves 10 can thus be closed with a delay with respect to the valve closing timing corresponding to the cam profile of the cam 12.

On the other hand, when the valves 10 are closed at a valve closing timing corresponding to the cam profile of the cam 12 (the case in which normal operation is performed), the control valve 28 is opened at a timing close to the peak position of the cam 12 (see a broken line in FIG. 3(*a*)).

Because the control chamber 21 is not tightly closed when the valves 10 are closed, the valves 10 and piston 19 are moved by the biasing force of the springs 11 in the valve closing direction (see broken line in FIG. 3(*c*)) and the working oil of the control chamber 21 is discharged by the piston 19 into the working oil tank 26 via the discharge line 25*b*.

Therefore, the pressure in the control chamber 21 does not rise and the valve closing operation of the valves 10 is practically identical to that of the conventional cam drive system.

Thus, as described hereinabove, in the present embodiment, the valves 10 operate following the cam profile of the cam 12 in a larger part of the range, except the case when the delayed closing operation of the valves 10 is performed. Therefore, the lift amount of the valves 10 can be controlled more accurately than in a variable valve driving device which opens and closes the valves hydraulically.

Further, in the present embodiment, the scope of changes introduced in the conventional valve driving device of a cam system is small and the structure is not more complex than that of the variable valve driving device which opens and closes the valves hydraulically. Therefore, the device can be manufactured at a low cost.

The preferred embodiment of the present invention is described above, but the present invention is not limited to the above-described embodiment and a variety of other embodiments can be employed.

Figure 4:
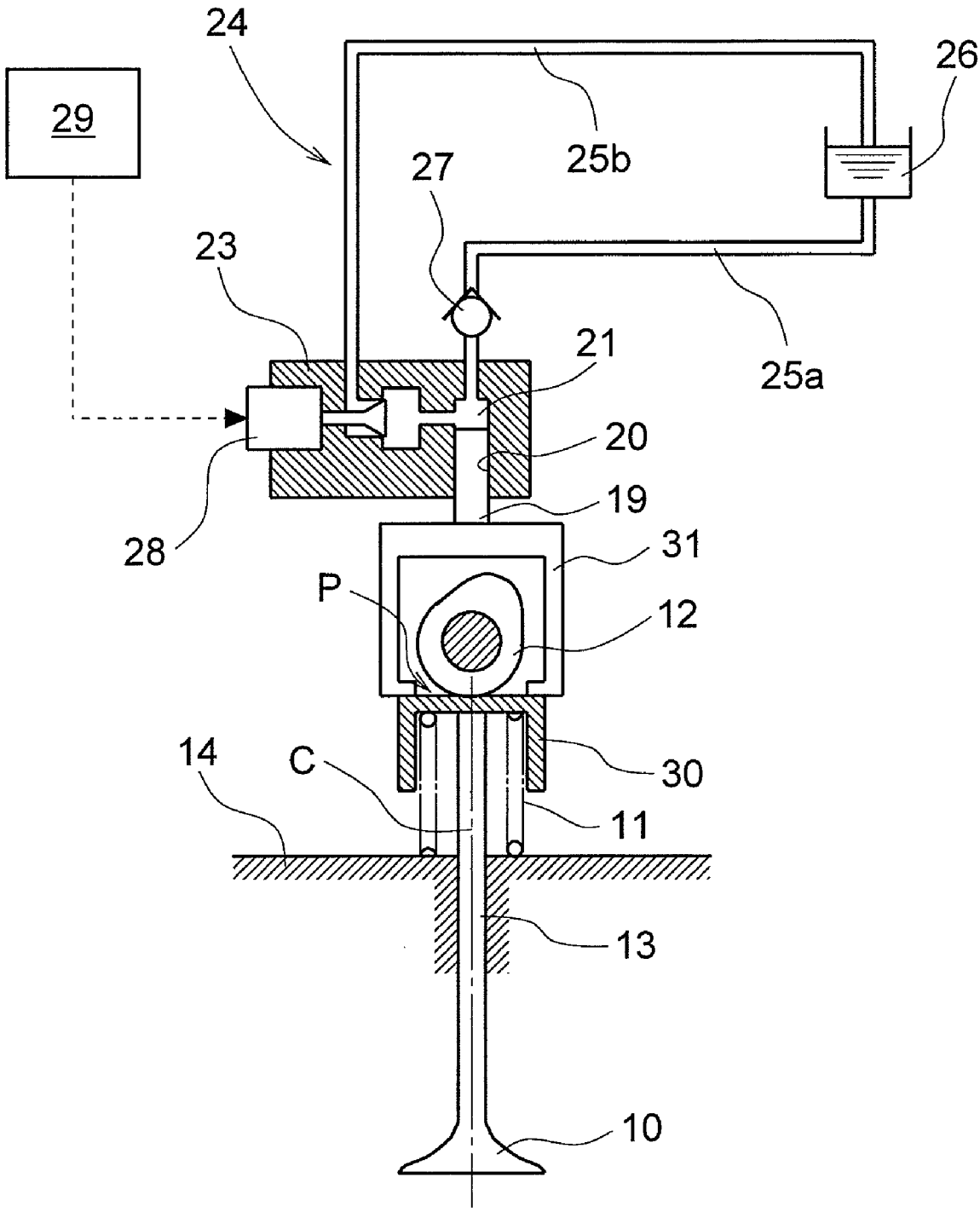
FIG. 4 is a schematic diagram of the variable valve driving device of a modification example, this diagram illustrating a state in which the valve is closed.

For example, the valves 10 may be directly pressed by the cam 12, as shown in FIG. 4. In this case, a tappet (valve lifter) 30 is attached to the valve 10, and the spring 11 is disposed in a compressed state between the tappet 30 and the cylinder head 14. Further, a bridge-like auxiliary member 31 having formed therein an opening for passing a camshaft therethrough is attached to the upper portion of the tappet 30, and the piston 19 is attached to the upper portion of the auxiliary member 31.

Further, the control chamber 21 may not be installed on the extension of the axial line C of the valves 10 (bridge 16).

In addition, the piston 19 may be attached to the retainer 15, valve stem 13, or rocker arm 17.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A variable valve driving device, comprising valves serving as intake valves or exhaust valves of an engine, springs for biasing the valves in the valve closing direction, a cam for pressing the valves in the valve opening direction against a biasing force of the springs, a piston joined to the valves, a control chamber configured by a piston insertion hole into which the piston is inserted, and a control mechanism for changing a valve closing timing of the valves by controlling the introduction and discharge of a working fluid into and from the control chamber;

wherein the piston is joined to the valves such that movement of the valves in the valve opening direction causes the piston to move and create a negative pressure in the control chamber so that working fluid is introduced into the control chamber.

2. The variable valve driving device according to claim 1, wherein when the valves are closed with a delay with respect to the valve closing timing corresponding to a cam profile of the cam, the control mechanism regulates the discharge of the working fluid introduced into the control chamber, whereby the working fluid is held in the control chamber.

3. The variable valve driving device according to claim 1, wherein the control mechanism has a working fluid tank connected to the control chamber, a first actuation valve for introducing the working fluid of the working fluid tank into the control chamber, and a second actuation valve for discharging the working fluid of the control chamber into the working fluid tank.

4. The variable valve driving device according to claim 1, wherein the valves are pressed by the cam directly or pressed by the cam via a rocker arm.

5. The variable valve driving device according to claim 1, wherein the control chamber is disposed on the side opposite the valves with respect to a pressure application point in which the cam or the rocker arm presses the valves.

6. The variable valve driving device according to claim 1, wherein the control chamber is disposed on an extension of an axial line of the valves.

* * * * *